United States Patent [19]

Matthews et al.

[11] 4,099,306

[45] Jul. 11, 1978

[54] SAFETY BUCKLE

[76] Inventors: Frank M. Matthews, 1514 Hillcrest Dr., Arlington, Tex. 76010; Terry O. McClain, Rte. 4, Box 262, Denton, Tex. 76201

[21] Appl. No.: 633,970

[22] Filed: Nov. 21, 1975

[51] Int. Cl.[2] ..... A44B 21/00

[52] U.S. Cl. ..... 24/69 SB; 24/205.17

[58] Field of Search ..... 24/73 PH, 69 SB, 69 ST, 24/69 R, 69 CF, 69 SK, 69 CT, 71 A, 71 ST, 71 T, 71 TT, 71 SK, 71 SB, 71 TD, 68 E, 68 T, 273, 205.17; 297/389

[56] References Cited

U.S. PATENT DOCUMENTS

| | | | |
|---|---|---|---|
| 103,142 | 5/1970 | Clingen | 24/71 ST |
| 255,857 | 4/1882 | Herrick | 24/69 SK |
| 461,848 | 10/1891 | Reist | 24/273 |
| 890,698 | 6/1908 | Olson | 24/73 PH |
| 1,303,652 | 5/1919 | Girdler | 24/69 SB |
| 2,458,810 | 1/1949 | Varney et al. | 24/179 |
| 3,774,870 | 11/1973 | Sheffield et al. | 24/73 PH |
| 3,925,853 | 12/1975 | Nicklin | 297/389 |

*Primary Examiner*—Kenneth J. Dorner
*Attorney, Agent, or Firm*—Charles W. McHugh

[57] ABSTRACT

A separable buckle (such as a seat belt buckle for occupants of vehicles) adapted to connect two separable belts. A first structural member in the form of a floating link is typically secured permanently to one end of a first belt. A second structural member is adapted to be permanently secured to the end of the other belt. Permanently attached to the second structural member is a lever which is pivotable about a control axis near the distal end of said second structural member. The control axis is preferably elevated above the plane defined by the remote ends of the two structural members. At an intermediate position along the lever is provided an open-face cusp, which is adapted to receive the distal end of the floating link. In latching the buckle, the lever is rotated to an extended position, and the distal end of the floating link is rested against the cusp. By rotating the lever through about 180° to a folded condition alongside the second structural member, the floating link is drawn toward the second structural member. By causing the lever to rotate "over-center", the buckle becomes essentially self-latching. Means are also provided for securing auxilliary straps, such as shoulder straps or leg straps, to the buckle when it is latched.

11 Claims, 13 Drawing Figures

SAFETY BUCKLE

This invention relates generally to buckles for connecting together separable belts and straps, and more particularly it relates to a buckle of the type which is useful in connecting seat belts for occupants of vehicles, or for connecting cargo straps in aircraft, etc.

Ever since it was first concluded that it might be advisable to secure a vehicle operator in his vehicle, there have been a multitude of proposals for accomplishing this goal. Examples of these include the buckles shown in U.S. Pat. No. 2,458,810 to Varney which discloses a buckle for an aviator's belt, and U.S. Pat. No. 3,600,768 to Romanzi et al., which discloses a buckle for use by occupants of an automobile. No doubt many of these prior-art devices have been adequate to meet the needs for which they were designed. But there are some very demanding circumstances, however, where commercially available seat belts and buckles therefore have simply not been adequate. Two of these special situations involve racing-car drivers and aircraft-stunt pilots; in both of these situations, it has heretofore been impossible to secure enough tension in the seat belts so as to adequately hold the operator in rigid contact with his vehicle. For example, in oval-track racing (on a dirt track) there are occasions when the driver would prefer to be in continuous contact with the chasis of his vehicle, so that hitting a bump in the road would not cause him to be lifted off of his seat and possibly lose any degree of control over steering, etc. The duration of a race may be relatively short; and during a short race it may even be personally desirable for the driver to tighten a seat belt and/or leg straps so tight that the belts would practically be painful—if only he could do so. Similarly, if a stunt pilot is interested in performing rolls in his airplane, he would probably not want to find his body hanging in air below the seat during those moments when his plane is inverted. And, the time during which he will be performing rolls and the like will usually tend to be relatively short; so, the pilot could tolerate a seat belt which is so tight as to practically be painful—if it gives him the safety and reliability he needs for the short duration of his flying. In both of these situations—as well as others—there has been a need for a buckle which could achieve a substantial amount of tension in the belts being joined.

Still another facet of safety belts for vehicle operators has been the desirability of having a single buckle which could effectively secure together a lap belt, one or more shoulder belts, and two leg straps. Furthermore, when such an assemblage of belts has been achieved, it is important that they be capable of being quickly released—especially when they are being used by a race car driver who is exposed to the risk of injury by fire if he cannot be quickly removed from a wrecked vehicle.

Too, there are still other situations where the tension in a belt or strap is of substantial interest to a shipper of goods, etc. For example, typing down loads in an airplane (where air turbulance may cause shifting of cargo) and securing loads in a railroad box car (where the shock occasioned by coupling and uncoupling freight cars can cause cargo to shift) are two other examples where substantial tension may be desirable in a belt or strap. Accordingly, it is an object of this invention to provide an improved buckle which is capable of achieving a truly substantial amount of tension in the belts being connected.

A further object is to provide a buckle wherein an increase in the tension in the two belts that have been connected serves to increase the latching force on the buckle.

Still another object is to provide a buckle which is particularly adapted for use by certain race car drivers, and which is capable of quickly and reliably joining a lap belt, two shoulder straps, and two leg straps with a single locking motion.

These and other objects are accomplished by providing a separable buckle which utilizes an "over-center" latching mechanism. Briefly, the buckle includes three principal elements, plus a high-strength pin that serves as a pivot axis for one of the elements. Two of these elements (a base plate and an active lever) are permanently joined together in an assembly and connected to one end of a belt. The third principal element is a passive and lever-like member that is connected to the other belt that is to be joined. A cusp-like recess on the active lever is adapted to engage a matching rod on the passive lever, and to swing the rod through an arc of up to (or sometimes even exceeding) 180°. During the course of swinging the rod through 180°, the belt attached to said rod is inherently tightened by twice the distance of said cusp from the pivot axis. Also, by providing that the rod will come to rest a few degrees beyond "dead center" with regard to belt alignment, the buckle inherently tends to remain latched for as long as the belts are maintained in tension. Manually swinging the active lever upward (or away from the torso of the person restrained by the joined belts) carries the passive lever to an unlatched position so that the belts may be easily separated. The invention should be clearly understood when the specification thereof is considered in conjunction with the attached drawings in which:

Figure 1:
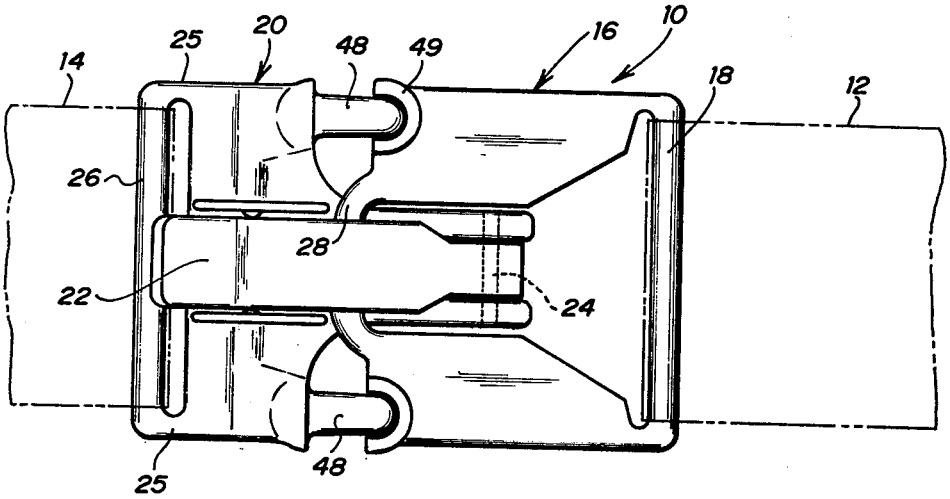
FIG. 1 is a top, plan view of one embodiment of the buckle, including two rods which are useful in securing the ends of transverse belts as well as anchor bars for connecting ends of two longitudinal belts.
Figure 2:
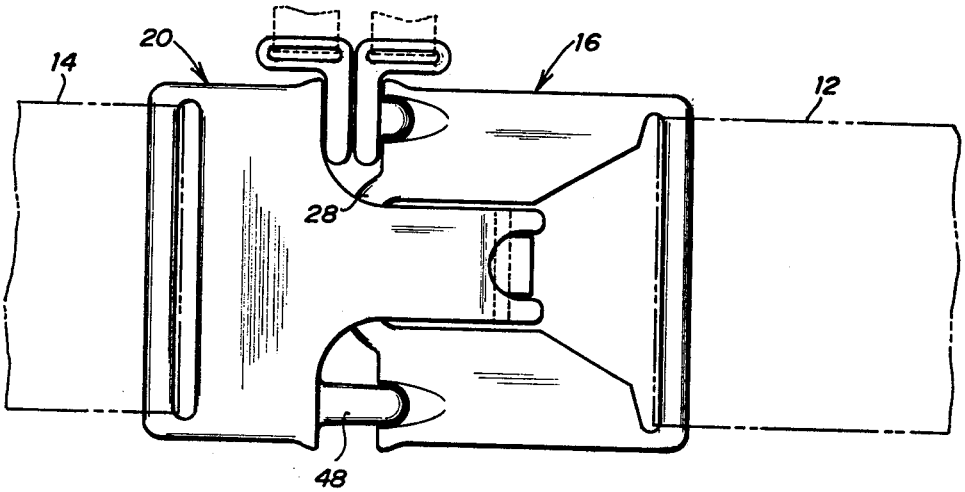
FIG. 2 is a bottom view of the buckle shown in FIG. 1, in its fully latched position.

Referring initially to FIG. 1, a preferred embodiment of a separable buckle 10 is shown connecting two separable belts 12, 14 which may be in the style of a conventional seat belt for autombiles or the like. The belts 12, 14 will typically be maintained in tension, which is of advantage in this construction since tension on the latched buckle will inherently tend to maintain it in a latched condition. However, an optional spring-loaded device (to be described later) can serve to hold the buckle securely in its latched condition, even when no tension is supplied by the joined belts.

The buckle 10 comprises three main elements, including a first structural member 16 which effectively constitutes a first pivotable lever; it is described as "pivotable" because, in one sense, it pivots about an anchor bar 18 which is attached to one of the belts 12. The member 16 is also aptly described as a floating link, in the sense that it is capable of moving or floating without thereby tending to open the buckle 10. The movement that is contemplated here is slight movement of the type that would result from a sudden shock load on the belt—as when a car is suddenly braked, causing a passenger to be thrown forward against the buckle. Since the remote ends of the belt are firmly anchored to the car, any forward movement of a passenger—no matter how slight—will tend to change the relative inclination of the parts of the buckle. The structural member 16 will typically be forged or otherwise fabricated from a unitary piece of metal, so as to inherently posses a substantial amount of strength.

A second structural member 20 includes a second lever 22 which is pivotable about a pin 24 which is permanently secured to the member 20, between two parallel side walls 21*a* and 21*b*. The pin 24 is spaced from the base of member 20 by a sufficient distance to permit unobstructed rotation of the lever 22 through a substantial angle, e.g., 180°. The location of the pin 24 is quite significant with regard to the operation of the buckle 10, such that it is quite appropriate to refer to the longitudinal axis of the pin 24 as being the "control" axis. The second structural member 20 also includes an anchor means, including an anchor bar for attachment to the second of the two belts that are to be connected, i.e., belt 14. As with other commercially available combinations of belts and buckles, it may be desirable to incorporate a certain amount of belt adjustment in the connection between the belt and a structural member of the buckle. That is, it may be desirable to take up several inches on the belt or let out several inches, before latching operation of the buckle is effected. Such an adjustment is possible with this buckle, although it does not constitute an integral part of the novel features thereof. The initial adjustment of belt length should be made, however, with the anticipation that latching action of the belt can be made to "take up" substantial slack in the belts. This will be explained more fully hereinafter.

Figure 3:
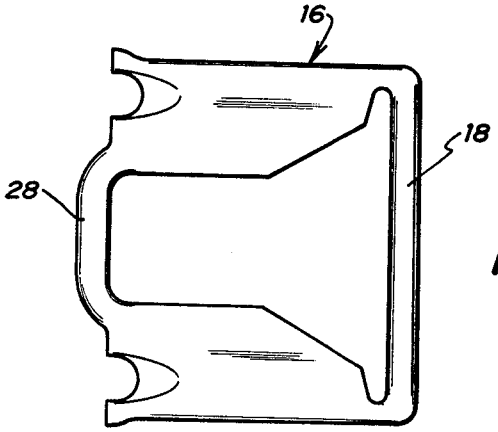
FIG. 3 is a front view of the floating link which constitutes one of the three principal elements in the buckle.

The second lever 22 has means intermediate its two ends for receiving the distal end 28 of the first lever 16 in abutting contact. (See also FIG. 3.) This means preferably constitutes a cusp or open recess 29 which faces outward (with respect to the person to be restrained by the belts) when the buckle is in an unlatched condition. Hence, it is very easy to initially put the two members 22, 16 into contact; and no precise initial alignment is required. Indeed, even if the belts 12, 14 are not exactly aligned when preliminary latching action has begun, the step of putting the buckle into a latched condition will inherently act to generally align the belts 12, 14.

Figure 5A:
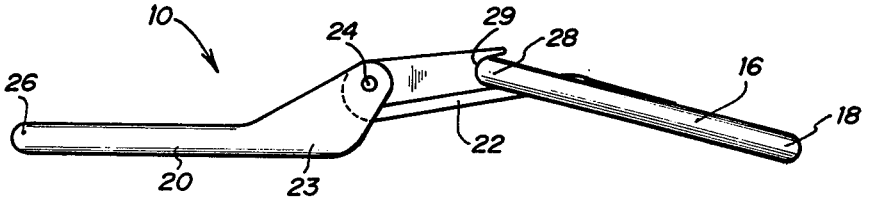
FIG. 5A is a side view of the buckle, shown diagrammatically, with the three parts in a position such as they might have at the initial stage of latching the buckle.
Figure 5B:
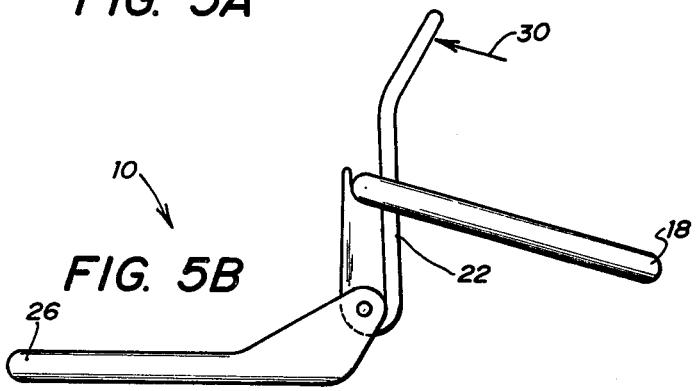
FIG. 5B is a view similar to FIG. 5A, wherein the parts have been moved to an intermediate position during a buckling operation.
Figure 5C:
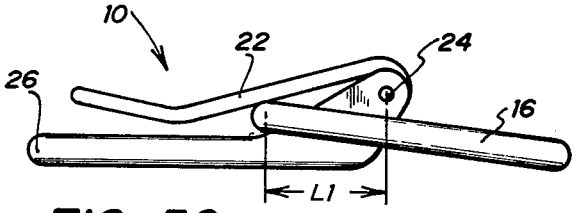
FIG. 5C is a view similar to FIG. 5A wherein the three main parts have been moved to a fully latched position.

Referring next to FIG. 5A, 5B and 5C, the relationship of the three principal parts will be more readily apparent. The device is shown in diagrammatic fashion for simplicity, with the general outline of the parts being shown to foster easier recognition. In FIG. 5A the distal end 28 of lever 16 is shown in a position such as it might have at the initial stage of a latching operation. The second structural member 20 is shown with the base lying flat and lever 22 rotated to its most extended position about pin 24. FIG. 5B illustrates the relative position of the parts when a latching force, represented by arrow 30, has been manually applied to rotate the lever 22 upward through an angle of about 90°. In this figure, it will be apparent that the anchor bar 18 has already been drawn inwardly toward anchor bar 26 by a substantial amount, but this is not a stable position; that is, anchor bars 18, 26 will maintain their relative position against tension in belts 12, 14 for only as long as a holding force 30 is maintained. In FIG. 5C, lever 22 has been fully rotated through an angle of about 180°, and the belts 12, 14 have been brought together by a distance which is approximately twice the distance between the control axis 24 and the cusp-shaped opening 29 (which is engaged by distal end 28). This length is represented in the drawing by the dimension $L_1$, and the maximum take-up length for the buckle 10 is twice that length. Of course, if the length adjustment of the belts is such that there is no significant tension in them until the member 16 has reached the position represented by FIG. 5B, then the actual take up will be only about one-half of the potential take up.

Figure 6:
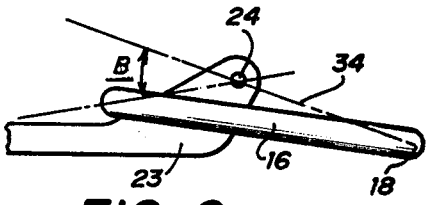
FIG. 6 is a diagram of the "over-center" relationship of the latched parts.

Referring next to FIG. 6, the "over-center" latching relationship of the elements 16, 22 will be explained. Assuming that the floating link 16 pivots about its anchor bar 18, it is in a stable condition in FIG. 6, because it is prevented from moving downward by the base of element 20; of course, element 20 is prevented from moving downward by either a person's torso (if the connected belts constitute "seat belts") or the exterior wall of a container (if the matter being restrained is cargo or the like). The only way that structural member 16 can be freed from its latched condition is to rotate it clockwise so that it passes through the plane 34 defined by anchor bar 18 and control axis 24. When member 16 lies precisely in plane 34, it can be at rest but it is not stable; shifting it slightly downward would restore it ti its latched state, and shifting it slightly upward would tend to promptly open the buckle. Indeed, a characteristic of the buckle 10 is to almost "throw" the buckle open if there is any significant tension in the joined belts, since such tension acts to further rotate member 16 in a clockwise direction after it is above the control axis 24. This is of distinct advantage for race car drivers, etc., since there is no drag or potential interference between mating parts—after the member 16 has been rotated to be above the control axis.

As for the degree of "over-center" latching action that may be desired, an angle B of at least 3° should be considered as "latching" the members—but only marginally so. An angle of at least 5° would offer greater security for the buckle as being firmly latched; and an angle of at least 8° would essentially guarantee that the elements are securely latched together. (It should be noted that the angle B shown in FIG. 6 has been exaggerated in the drawing, for clarity.) Of course, the angle B could be increased even beyond 8°, but doing so would reduce some of the tension-generating capability of the buckle. Hence, providing an "over-center" angle in excess of about 8° would seem to be generally unproductive, at least with regard to tension in the belts.

Figure 10:
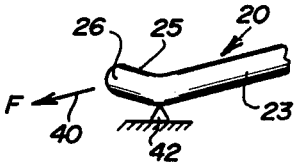
FIG. 10 is a fragmentary view of the anchor end of the second structural element.

Referring next to FIG. 10, which is a fragmentary view of the anchored end of member 20, another structural feature of the buckle 10 will now be examined. The anchor bar 26 is shown as being slightly higher than the base 23, and it is structurally connected to base 23 by two upwardly inclined arms 25, with one of the arms being at respective ends of the anchor rod 26. Thus, any substantial tension force in the direction represented by arrow 40 will tend to cause member 20 to rotate counter-clockwise about a fulcrum represented by element 42. The effect of this is to lift pin 24 at the right end of member 20; and, since member 16 is free to rotate with respect to lever 22, the effect will typically be to increase angle B. Thus, once the buckle has been latched, any increase in tension in the joined belts only tends to hold the buckle more securely latched. Explained another way, any deficiency in initially tightening the belts is self-correcting when a surge or jerk would tend to pull the belts apart.

Figure 7:
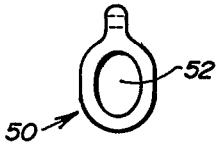
FIG. 7 is a front view of a structural loop which is adapted to mate with a protruding rod on one of the structural members.
Figure 8:
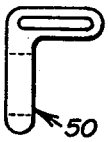
FIG. 8 is a side view of the structural loop shown in FIG. 7.

Referring next to FIG. 7, a structural loop 50 is shown. Said loop 50 is adapted to slide over and be securely held to the buckle 10 by one of the protruding rods 48 shown in FIG. 1. The bore or opening 52 in said loop is preferably non-round, so that there will be no tendency for said bore to become wedged about the generally cylindrical rod 48. Attached to one end of the loop 50 is a link 54 through which an auxilliary securing strap may be threaded. When the loop 50 is securely held by a latched buckle 10, straps (such as shoulder straps and/or leg straps) may be securely held together—although not with the same degree of tension obtained in the two belts affixed to anchor bars 18, 26.

Referring again to FIG. 1, the protruding rod 48 is shown engaged with a generally cylindrical recess 49 on floating link 16. The longitudinal axis of recess 49 is generally perpendicular to the longitudinal axis of protruding rod 48. Also, it will be apparent from the drawing that the recess 49 has an open side which faces in the direction of the mating rod 48. Hence, the rod 48 may intersect the recess 49 with essentially an infinite number of angles. Also, while the rod 48 and recess 49 are quite adequate to restrain rigid loops 50 against vertical movement of any auxilliary straps, they do not interfere in any way with opening or latching of the buckle 10. Furthermore, even when the buckle is fully latched, there is a substantial degree of freedom (i.e., permitted relative motion) between theelements 16, 20 about an axis that is parallel to the cusp on the lever 22, without any force being introduced which would tend to unlatch the buckle.

While the protruding rods 48 are shown on the member 20 and the mating cylindrical recesses 49 are shown on floating link or lever 16, it will perhaps be apparent that the relative location of these two elements could be reversed without affecting their operation, e.g., the rods 48 could be put on link 16.

Figure 9:
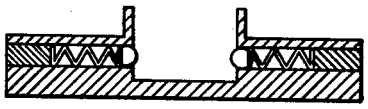
FIG. 9 is a view taken along the line IX—IX in FIG. 4, and showing an optional spring-biased means for holding the lever in a folded position with respect to the second structural member.

Referring next to FIG. 9, an optional spring-biased means 60, in the form of a spring-loaded ball, is shown for holding the lever in a folded position with respect to the second structural member 20. This means 60 is preferably sized so as to hold the lever 22 against an outward force of less than 5 pounds. However, the means 60 should not require a force of more than 8 pounds to release the lever 22. A resisting force of about 6 pounds is preferred for holding the lever secure against the member 20.

Figure 4:
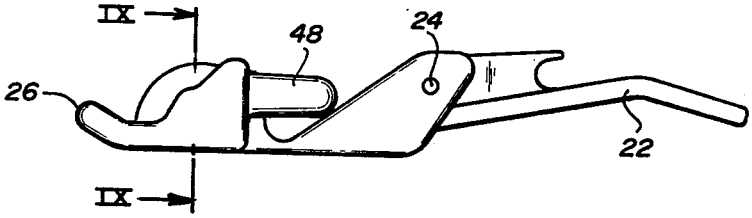
FIG. 4 is a side view of the other two principal elements of the buckle, with the latching lever being rotated to its extreme "open" position for receiving the floating link shown in FIG. 3.
Figure 11:
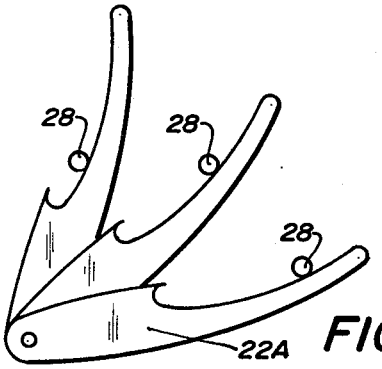
FIG. 11 is a side view of an alternate embodiment of a latching lever.

While the invention has been described with particular detail in its application to seat belts for vehicles, it will be apparent to those skilled in the art that the buckle could also be advantageously used in holding cargo—as well as people. And, while only the preferred embodiments of the invention have been disclosed in substantial detail herein, it will be apparent to those skilled in the art that modifications thereof can be made without departing frm the spirit of the invention. Thus, the specific structures shown herein are intended to be exemplary and are not mant to be limiting, except as described in the claims appended hereto. For example, in FIG. 7 of the drawing the bore 52 in rigid loop 50 is drawn in proportion for the preferred embodiment, wherein the length of the bore is about 1½ times as long as its width. Also, the "take-up" distance, i.e., the lineal distance through which the cusp 29 moves as the lever 22 is rotated from its full-extended position is about two inches in the "seat belt" embodiment. But, each of these preferred dimensions could be varied at will. Also, the specific shape of the lever 22 would likely be altered if the primary use of the buckle 10 is to be holding cargo. That is, the lever 22 shown in FIG. 4 has an outward flair to its distal end—to foster the manual movement of the lever with respect to the control axis 24. With a buckle for cargo use, however, the distal end of the lever 22 would likely be turned down (facing the base 23) instead of up. In such a case, the distal end (or hook) on link 16 could be physically pulled toward member 20 by a camming action on the inside surface of lever 22A; in this way even before the hook 28 ever makes contact with cusp 29A, a certain amount of tension can be introduced into the belts that are to be joined. (This extra take-up action, sometimes called a "ramping" action, is schematically shown in FIG. 11.)

What is claimed is:

1. A separable buckle adapted to connect two separable belts which normally are maintained in tension when they are connected, comprising:

(a) a first structural member constituting a floating link of given length, with the link being connected to and pivoting about a point at one end of a first belt, and the distal end of said floating link being generally cylindrical so as to foster rotative contact with an abutting structure;

(b) a second structural member including a base plate and a lever which is permanently secured to the base plate in a manner that provides for pivotable movement about a control axis on the base plate, with the control axis being transverse to the orientation of the two belts being joined, and the base plate being connected to an end of the second belt, said lever having a length which extends from a remote free end to a second end adjacent the control axis and said lever having a cusp-shaped opening between its free end and said control axis, with said cusp-shaped opening lying on a line that extends generally between the lever's free end and the control axis, and said cusp-shaped opening being oriented and sized to selectively receive and hold the distal end of said floating link in abutting contact, and the control axis being located such that the buckle is not only unlatched but also tends to separate when the two belts are in tension and the plane of the floating link is positioned above the control axis, and such that the buckle remains firmly latched together when the two belts are in tension and the plane of the floating link is positioned below the control axis; and (c) means for manually moving the lever above and below the control axis, with said moving of the lever causing shifting of the floating link when the link's distal end is engaged with the lever, whereby manually displacing the lever through a relatively small angle of as little as 3° can cause the floating link to be shifted to and from a secured state, and the buckle can be thereby changed to and from a latched condition.

2. The buckle as claimed in claim 1 wherein a plane is defined by the control axis and the end of the first belt when the buckle is latched, and wherein a line which extends from the control axis toward the distal end of the floating link extends in a direction downwardly away from said plane and toward the second belt, and said line makes an angle of at least 3° with the plane defined by the control axis and said end of the first belt, but not much more than about 8° with said plane.

3. The buckle as claimed in claim 2 wherein said line which extends from the control axis to the distal end of the floating link when the buckle is latched makes an angle of about 5° with the plane defined by the control axis and said end of the first belt, whereby the lever must be raised by an angle of about 5° in order to unlatch the buckle.

4. The buckle as claimed in claim 1 wherein a fulcrum point is provided between the end of the second belt and the distal end of the floating link, with said fulcrum point being on said base and in a position to bear against some structure being secured by the two separable belts, such that an increase of tension in the second belt tends to rotate the base about the fulcrum point and to increase the angle through which the lever would have to pass in order to unlatch the buckle.

5. The buckle as claimed in claim 1 and further including at least one protruding rod and a matching recess for receiving said rod, with the protruding rod being on one structural member and the matching recess being on the other of the two structural members, and the protruding rod and the recess being engaged when the two structural members are latched together, with at least a portion of the engaged rod being accessible from the exterior of the buckle.

6. The buckle as claimed in claim 5 and further including a rigid loop having a bore which is sized so as to slide over the protruding rod and be held thereby, and said loop having means for connection with an auxiliiary holding member.

7. The buckle as claimed in claim 6 wherein the protruding rod is generally cylindrical and the bore in the structural loop is non-round.

8. The buckle as claimed in claim 1 wherein the two separable belts are vehicle seat belts, and further including means for simultaneously securing the ends of one or more shoulder straps and one or more leg straps to the buckle upon the buckle being latched.

9. A separable belt buckle which is capable of introducing tension into two longitudinally aligned belts during the latching operation of the buckle, comprising:

(a) a first structural member adapted to be securely connected to the end of one belt;

(b) a second structural member adapted to be securely connected to an end of the second belt;

a lever permanently mounted for rotation at the distal end of said second structural member, with the plane of rotation of said lever being in line with the longitudinal axes of said belts, and said lever having means intermediate its length for engaging the distal end of said first structural member and pulling same toward said second structural member when said lever is rotated from an extended position to a folded position; and (d) oppositely facing and complementary elements on the first and second structural members which are adapted to slide together in an axial direction and to interlock upon rotation of said lever to a folded position, and there being a space between said first and second structural members in the region adjacent the interlocked elements, whereby additional belts or straps may be selectively secured to the buckle by engagement with at least one of said interlocked complementary elements when the buckle is latched.

10. The buckle as claimed in claim 9 wherein said oppositely facing and complementary elements on the first and second structural members constitute a generally cylindrical rod extending in a cantilevered fashion from one structural member toward the other, with the complementary element constituting a generally semicylindrical recess having a longitudinal axis approximately perpendicular to the longitudinal axis of said cylindrical rod, with said recess having an open side for receiving said cylindrical rod, whereby the cylindrical rod may intersect said cylindrical recess with essentially an infinite number of angles.

11. The buckle as claimed in claim 9 wherein the intermediate means on said lever constitutes a cusp-shaped opening, and wherein said cusp-shaped opening traverses a lineal distance of about 2 inches when the lever is rotated from its full-extended position to its full-latched position, whereby the take-up distance on the belts to be joined is a corresponding distance of about 2 inches.

* * * * *